US006907701B2

(12) United States Patent
Smith

(10) Patent No.: US 6,907,701 B2
(45) Date of Patent: Jun. 21, 2005

(54) STEEL ROOFING PANEL SUPPORT

(76) Inventor: Gary Edward Smith, 5291 Fanwood Dr., Huntington Beach, CA (US) 92649

( * ) Notice: Subject to any disclaimer, the term of this patent is extended or adjusted under 35 U.S.C. 154(b) by 64 days.

(21) Appl. No.: 10/165,601

(22) Filed: Jun. 7, 2002

(65) Prior Publication Data

US 2002/0189186 A1 Dec. 19, 2002

Related U.S. Application Data

(60) Provisional application No. 60/296,579, filed on Jun. 7, 2001.

(51) Int. Cl.[7] ..... E04D 1/00

(52) U.S. Cl. ..... 52/506.01; 52/309.8; 52/409; 52/478; 52/551; 52/560

(58) Field of Search ..... 52/748.1

(56) References Cited

U.S. PATENT DOCUMENTS

| | | | | | |
|---|---|---|---|---|---|
| 368,386 | A | | 8/1887 | Donaldson | |
| 1,438,302 | A | * | 12/1922 | Frederiksen | |
| 1,963,583 | A | * | 6/1934 | Jenkins | 52/520 |
| 2,110,579 | A | | 3/1938 | Robinson | |
| 2,264,546 | A | * | 12/1941 | Ochs | 52/521 |
| 2,418,758 | A | | 4/1947 | Cooper | |
| 2,592,482 | A | | 4/1952 | Sperry | |
| 3,248,835 | A | * | 5/1966 | Westlind | 52/404.4 |
| 3,324,617 | A | * | 6/1967 | Knight et al. | 52/481.1 |
| 3,367,079 | A | * | 2/1968 | Berg | |
| 3,373,534 | A | * | 3/1968 | Berridge | |
| 3,520,099 | A | * | 7/1970 | Mattes | 52/531 |
| 3,552,078 | A | * | 1/1971 | Mattes | 52/520 |
| 3,605,369 | A | * | 9/1971 | Merrill | 52/530 |
| 3,703,795 | A | * | 11/1972 | Mattes | |
| 3,780,483 | A | * | 12/1973 | Mattes | |
| 3,826,054 | A | * | 7/1974 | Culpepper, Jr. | 52/309.8 |
| RE28,583 | E | * | 10/1975 | Hughes | 52/560 |
| 4,033,802 | A | * | 7/1977 | Culpepper et al. | 156/71 |
| 4,065,899 | A | | 1/1978 | Kirkhuff | |
| 4,081,939 | A | * | 4/1978 | Culpepper et al. | 52/535 |
| 4,120,132 | A | * | 10/1978 | Kendrick | 52/478 |
| 4,160,346 | A | | 7/1979 | Kaufmann | |
| 4,191,722 | A | * | 3/1980 | Gould | 264/45.5 |
| 4,320,613 | A | * | 3/1982 | Kaufman | 52/521 |
| 4,399,643 | A | * | 8/1983 | Hafner | 52/530 |
| 4,432,181 | A | * | 2/1984 | Funaki | |
| 4,445,305 | A | * | 5/1984 | Orie, Sr. | 52/309.9 |
| 4,446,665 | A | * | 5/1984 | Berger | 52/407.4 |
| D274,947 | S | * | 7/1984 | Culpepper et al. | D25/139 |
| 4,467,580 | A | * | 8/1984 | Sowinski | |
| 4,506,486 | A | * | 3/1985 | Culpepper et al. | 52/529 |
| 4,530,193 | A | | 7/1985 | Ochs | 52/408 |
| 4,642,950 | A | | 2/1987 | Kelly | |
| 4,691,491 | A | * | 9/1987 | Lilley | |
| 4,788,808 | A | | 12/1988 | Slocum | |
| 4,803,818 | A | * | 2/1989 | Funaki | 52/520 |

(Continued)

FOREIGN PATENT DOCUMENTS

FR 2 583 091 12/1986

OTHER PUBLICATIONS

Documents relating to Gerard roofing support including, 4 pages from Gerard roofing tile installation manual, 2 photographs of Gerard support, and Frequently Asked Questions from Gerard website in 2 pages.

*Primary Examiner*—Robert Canfield
(74) *Attorney, Agent, or Firm*—Knobbe Martens Olson & Bear, LLP

(57) ABSTRACT

A steel roofing panel support system is disclosed herein. The system generally includes a support element positioned on a roof surface, the support being configured to support at least a portion of a steel roof panel to be placed thereon. The support element may be cut from a block of expanded polystyrene such that the support is substantially wedge-shaped. A support element as disclosed herein may also be used in installations of steel panels over existing wood shakes or other roof surfaces.

19 Claims, 8 Drawing Sheets

U.S. PATENT DOCUMENTS 4,854,102 A 8/1989 Feil et al.
4,926,611 A * 5/1990 Funaki ..... 52/748.1
4,969,302 A * 11/1990 Coggan et al. ..... 52/309.8
5,005,323 A * 4/1991 Simpson et al. ..... 52/90.2
5,016,415 A * 5/1991 Kellis ..... 52/522
5,056,288 A * 10/1991 Funaki ..... 52/545
5,214,895 A 6/1993 Fifield
5,222,337 A 6/1993 Thomsen et al. ..... 52/404
5,369,926 A 12/1994 Borland
5,442,888 A 8/1995 Ilnyckyj
5,471,807 A * 12/1995 Vasquez
5,473,847 A 12/1995 Crookston ..... 52/302.1
5,502,940 A 4/1996 Fifield
5,570,555 A * 11/1996 Ferguson et al. ..... 52/551
5,598,677 A * 2/1997 Rehm, III ..... 52/407.1
5,636,489 A * 6/1997 Leverrier et al. ..... 52/540
5,664,376 A * 9/1997 Wilson et al. ..... 52/287.1
5,737,881 A * 4/1998 Stocksieker ..... 52/90.1
5,974,756 A 11/1999 Alvarez et al. ..... 52/553
6,029,415 A * 2/2000 Culpepper et al. ..... 52/522
6,047,419 A * 4/2000 Ferguson
6,182,404 B1 * 2/2001 Rinklake et al.
6,263,574 B1 * 7/2001 Lubker et al. ..... 29/897.32
6,418,692 B1 * 7/2002 Freshwater et al. ..... 52/553
6,487,826 B1 12/2002 McCorsley et al. ..... 52/408
6,526,718 B2 * 3/2003 Manning et al. ..... 52/555
2002/0029537 A1 * 3/2002 Manning et al. ..... 52/518

* cited by examiner

STEEL ROOFING PANEL SUPPORT

RELATED APPLICATION

This application claims priority under 35 U.S.C. § 119(e) to U.S. Provisional Application 60/296,579, filed Jun. 7, 2001.

BACKGROUND

1. Field of the Invention

The present invention relates generally to roofing products, and more specifically, to a roof panel support that allows individuals to walk on a steel panel roof without permanently deforming the steel panels.

2. Description of the Related Art

Steel panel is a common roofing material for use on new construction as well as reroofing installations over existing wood shake roofs. It is very popular for its lightweight, yet weatherproof properties as well as its ease of installation. The thin, lightweight nature of the steel panel allows it to be easily and cost-effectively installed on new construction, or over existing wood shake. An example of a steel roofing panel is described in U.S. Pat. No. 4,932,184 to Waller.

In a typical installation, 2×2 inch wood strips are attached horizontally to the roof to act as battens on which the front of the steel panels will rest. Raising the front of the steel panel in this way creates a space between the roofing surface and the underside of the roofing panel. Unfortunately, due to the thinness of the steel panels, they tend to bend and permanently deflect when the roof is walked on. In addition to being unsightly, damaged steel roofs may not provide adequate water drainage or weather protection.

Some attempts have been made to provide custom-shaped supports underneath the steel panel. These supports are molded to exactly match the profile of the roofing panels. The cost of the molds required are typically quite substantial and in some cases, too expensive to justify the use of such supports. Such molded supports also have the limitations that they are only compatible with the specific panel for which they were designed. Additionally, such conforming supports tend to be somewhat difficult to install due to the difficulty in ensuring that the supports are aligned with the panels.

SUMMARY

The present roof panel support recognizes the desirability of being able to walk on a steel panel roof with confidence that the steel panels will not be permanently bent or otherwise damaged. The present roof panel support satisfies the need for a steel roof panel support element that is compatible with a broad range of steel roof panels, is adjustable during installation, allows individuals to walk confidently on a steel panel roof without damaging the panels, and provides thermal insulation.

In one embodiment, a support element is preferably wedge-shaped to provide support under as much of the steel panel as possible, while remaining as inexpensive as possible. The wedge-shaped support element is preferably made of expanded polystyrene so that it is lightweight, durable, semi-compressible, fire safe, inexpensive and easy to manufacture and install. Steel roof panels placed on the wedge-shaped support elements are preferably supported slightly above the next lower course of steel panels.

Support elements are preferably independent of the steel roof panels. Individual support elements can be mass-produced for use with different, but similar, kinds of steel panel. Additionally, during installation the steel roof panels can be adjusted forward or backward with respect to the support element in order to increase or decrease the head lap of the steel panels. Support elements that are not attached to steel panels, and have a uniform quadrilateral or triangular cross-sectional shape, are more cost effective in terms of packaging and delivery than combined structures.

In another embodiment, support elements may be used in steel-panel installations over existing roofing surfaces. When a steel-panel system is installed over an existing roofing surface such as wood shakes, a wood framework is laid over the roofing surface. Typically, 1×4 inch wood strips are run vertically up the roof, and the 2×2 inch battens run horizontally as in a new installation. In order to use support elements to support the steel panels, the space between the 1×4 strips must be filled. This may be accomplished by using a riser (typically ¾-inch), or by increasing the dimensions of the support element. Risers to be used in accordance with the present invention are also preferably made of expanded polystyrene so that they are lightweight, durable, semi-compressible, fire safe, inexpensive and easy to manufacture and install.

One of the preferred methods for installing steel roof panel supports comprises placing a support element on a roofing surface, placing a steel roof panel over the support element, and securing the steel roof panel to the roofing surface.

For purposes of summarizing the invention and the advantages achieved over the prior art, certain objects and advantages of the invention have been described herein above. Of course, it is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

All of these embodiments are intended to be within the scope of the present invention herein disclosed. These and other embodiments of the present invention will become readily apparent to those skilled in the art from the following detailed description of the preferred embodiments having reference to the attached figures, the invention not being limited to any particular preferred embodiment(s) disclosed.

BRIEF DESCRIPTION OF THE DRAWINGS

Having thus summarized the general nature of the invention, certain preferred embodiments and modifications thereof will become apparent to those skilled in the art from the detailed description herein having reference to the figures that follow, of which.

DETAILED DESCRIPTION OF THE PREFERRED EMBODIMENT

Figure 1:
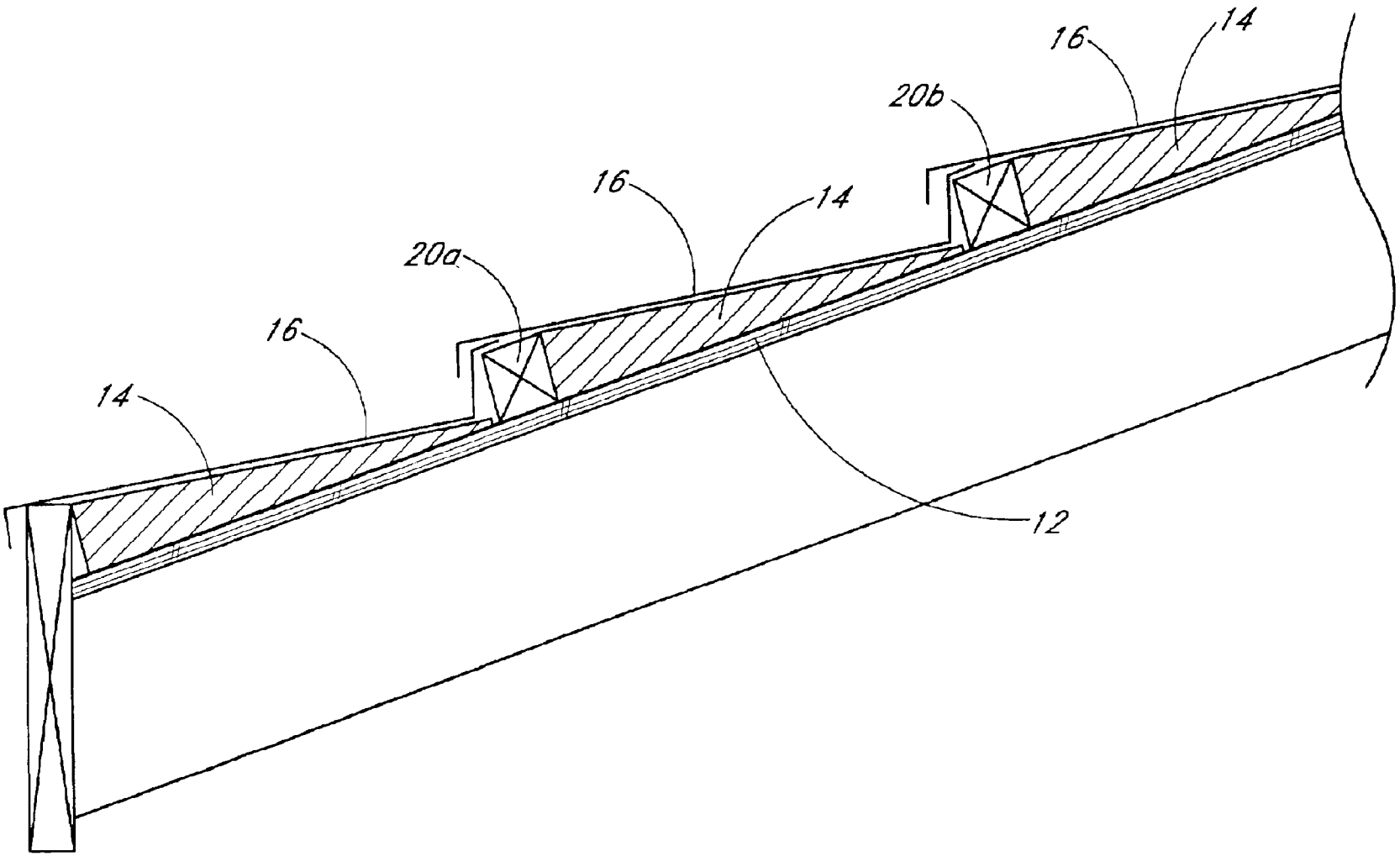
FIG. 1 is a side section view of a steel panel roofing system incorporating support elements.

In an embodiment as shown in FIGS. 1 and 2, a steel roof panel support element 14 fits between steel roof panels 16 and a roofing surface 12 to provide support for the steel roof panels 16. Preferably, a support element 14 is wedge-shaped to provide support under as much of the steel panel 16 as possible. The support element 14 is preferably made of expanded polystyrene so that it is lightweight, durable, semi-compressible, fire safe, inexpensive and easy to manufacture and install. Alternatively, the support element 14 may be made of other materials such as foam, rubber, plastic, wood, or any other material which provides sufficient support when used as described herein.

FIG. 1 illustrates a typical installation of a steel roof panel 16 with a support element 14 having preferred features and advantages on a newly-constructed roof. In a typical installation on a new roof, battens 20 are preferably attached to the roof horizontally in a manner consistent with the particular steel roof panels to be used. Support elements 14 are then placed on the roofing surface 12 such that the larger dimension of the wedge shape is adjacent to the next lower batten 20*a*, and the short side of the support element 14 is adjacent to the next higher batten 20*b*. A roof panel is then placed over the support elements 14 and attached to the roofing surface using nails or other method known in the art. Embodiments of the roof panel support vary depending on the type of support elements 14 and steel roof panels 16 used.

The steel roof panel 16 may be placed so that it is in contact with, and rests completely on, the support element 14. Alternatively, the steel panel 16 may be placed so that it rests on the support element 14 and the roofing surface 12, or in another method, the steel roof panel 16 may be placed so that it rests on a support element 14 and the next lower batten 20*a*. In still another embodiment, the steel roof panel 16 may be placed so that it rests on the roofing surface 12, the support element 14, and both the upper and lower battens 20*a* and 20*b*, respectively.

Preferably, the steel roof panels 16 are placed over the support elements 14 and then secured to the roofing surface using roofing nails. In a preferred method of installation, the nail passes through both the steel roof panel 16 and the support element 14 and into the roofing surface 12 to secure the steel panel 16. In another preferred method, the nail passes through the steel panel 16 and into the roofing surface 12 and the weight of the steel panel 16 as well as the location of the battens 20 act to secure the support element 14. One method of installing support elements 14 for use with steel roof panels 16 includes positioning a second support element 14 in a horizontal row next to a first support element 14, leaving a gap between the sides of the two support elements 14 to facilitate water drainage down the roof.

Figure 2A:
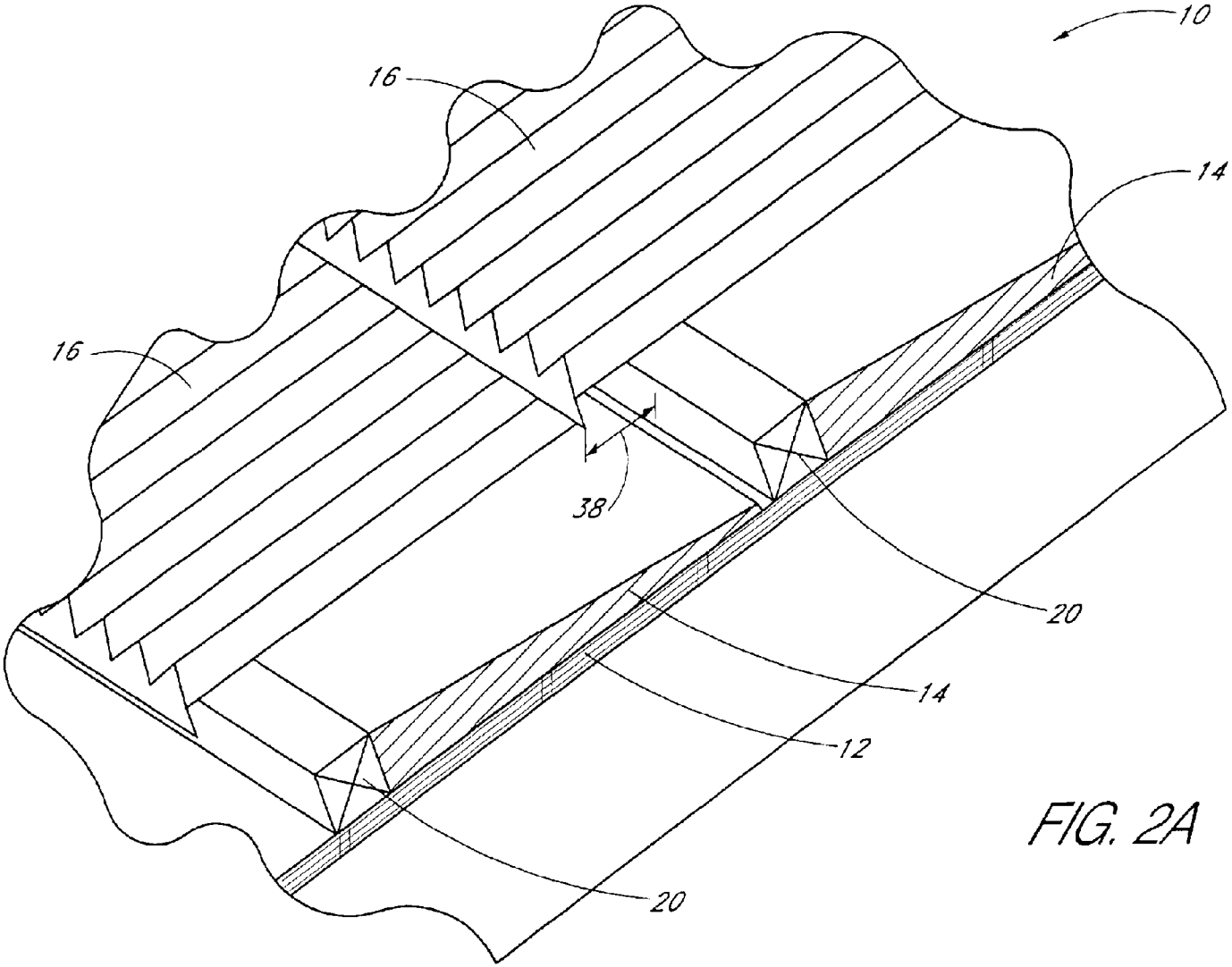
FIG. 2A is a perspective view of the roofing system of FIG. 1.
Figure 2B:
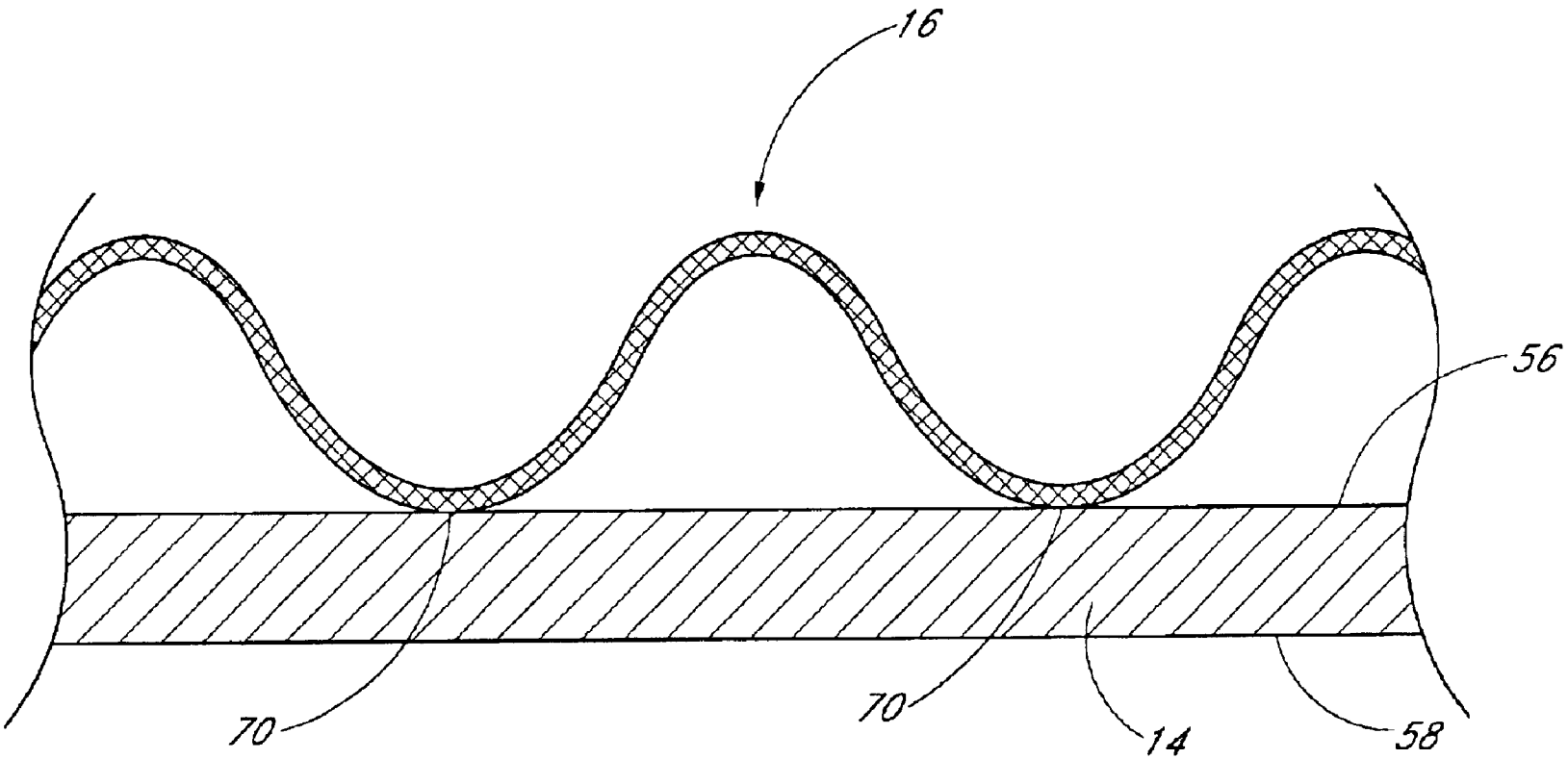
FIG. 2B is a front section view of an alternate roofing system of FIG. 1.

In FIGS. 2A and 2B, a steel roof panel support system 10 is shown covering a portion of a roof. The roofing surface 12 has battens 20 attached horizontally along the roof. These battens are typically 2×2 wood strips, however they may comprise other materials and sizes as known to those skilled in the art. Wedge-shaped roof panel support elements 14 are shown resting on the roofing surface 12. A steel roof panel 16 is shown resting on a roof panel support element 14.

Support elements 14 are preferably arranged in rows and preferably rest directly on the roofing surface 12. A support element 14 in a row is preferably one or two inches away from the next support element 14 in the row, although support elements 14 may be arranged on a roofing surface 12 with little or no space between them.

The steel roof panels 16 are preferably secured in place using nails appropriate for use with steel roof panels 16. The nails may pass through both the steel roof panel 16 and the support element 14. In other embodiments, the nails may only pass through the steel roof panels 16. Support elements 14 are preferably independent of the steel roof panels 16 in that the support elements 14 are not necessarily formed integrally with, nor attached directly to a steel roof panel. Support elements 14 are also typically independently shaped from steel roof panels in order to allow a support element to be used with a variety of steel roof panels. During installation, steel roof panels 16 can be adjusted forward or backward with respect to an independent support element 14 in order to increase or decrease the amount of overlap 38 of the steel panels 16.

Figure 3A:
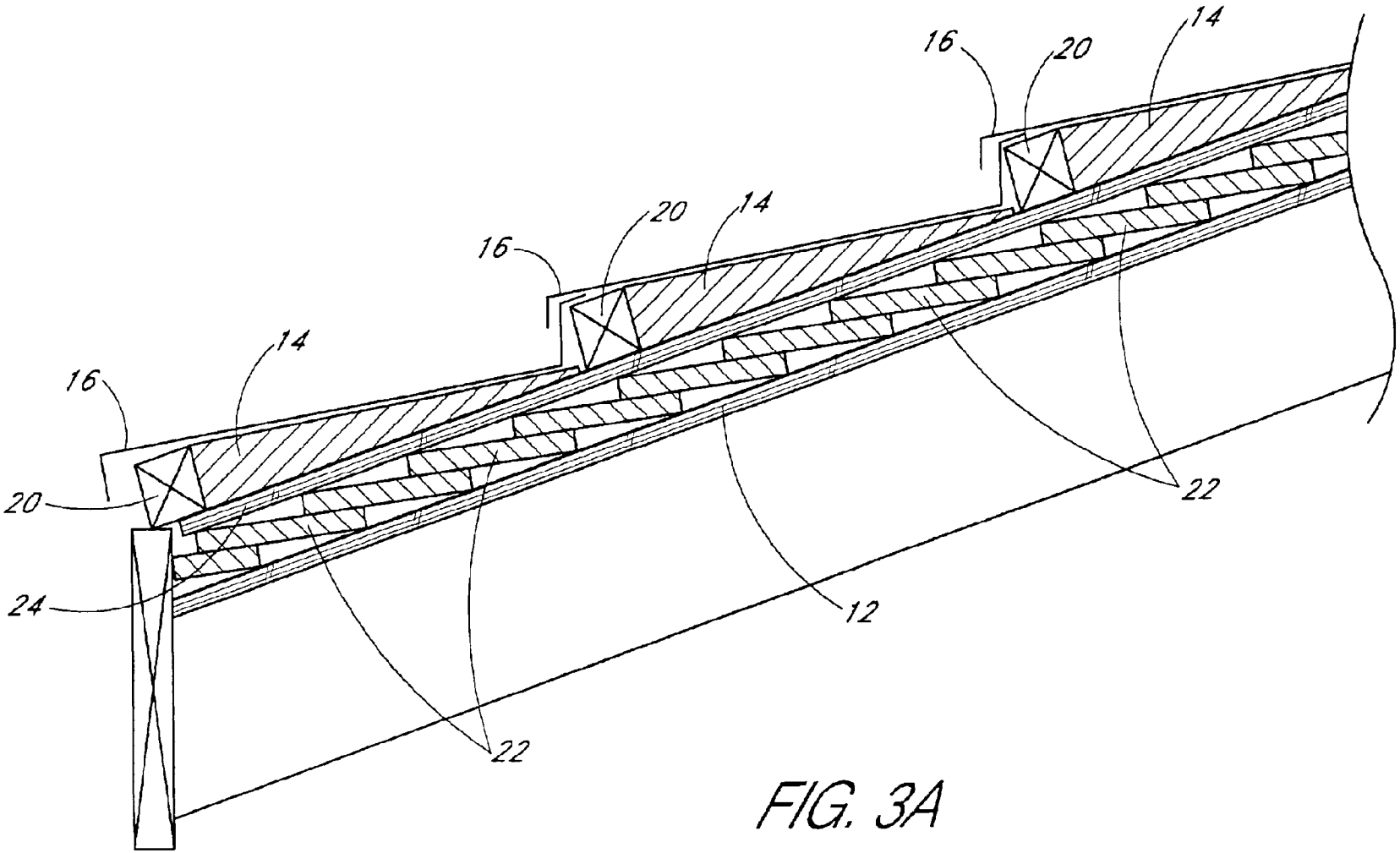
FIG. 3A is a section view of a steel panel roofing system installed over an existing shake roof and incorporating support elements.
Figure 3B:
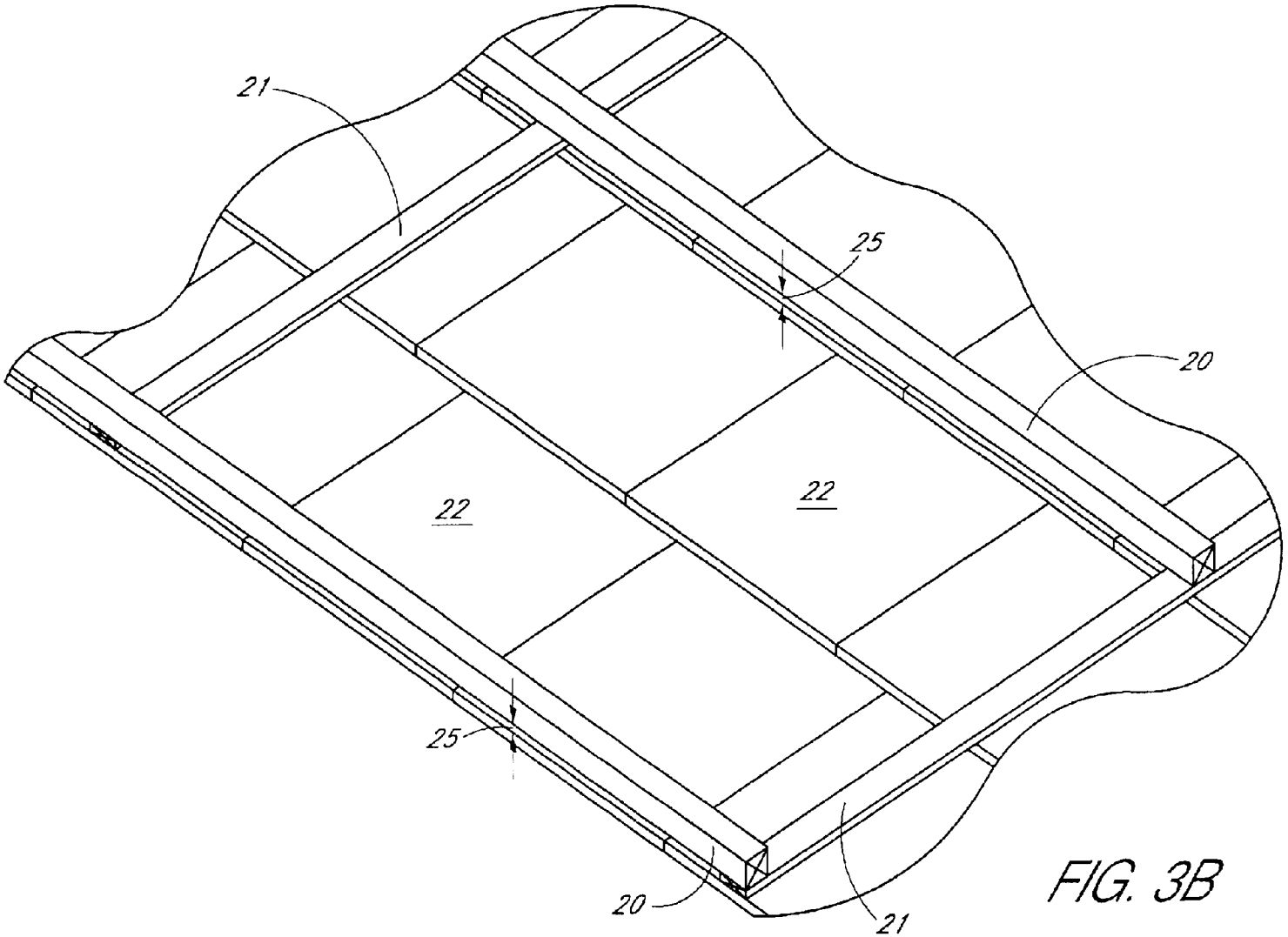
FIG. 3B is a perspective view of a frame structure for use in installing a steel panel roofing system as in FIG. 3A.

With reference now to FIGS. 3A and 3B, support elements may be used in steelpanel installations over existing roofing surfaces such as wood shakes 22. Typically, when a steel-panel system is installed over an existing roofing surface, a wood framework such as that shown in FIG. 3B, is laid over the existing wood shakes 22. In a standard installation of steel panels over existing roofing, wood strips 21 (typically 1×4 inch nominal) are run vertically up the roof to support the horizontal battens 20 (typically 2×2 inch). The use of the 1×4 inch vertical strips creates a space 25 which is about ¾" larger than the similar space created in an installation on new construction. Thus in order to use support elements 14 to support the steel panels 16 above existing roofing material, the extra space 25 created by the wood strips 21 must be filled. This may be accomplished either by an appropriately sized (typically ¾-inch) riser 24, or by increasing the dimensions of the support elements 14 to fill the extra space. Risers 24 to be used in accordance with the roof panel support are also preferably made of expanded polystyrene so that they are also lightweight, durable, semi-compressible, fire safe, inexpensive and easy to manufacture and install.

Installation of steel roof panels with support elements over an existing roof is generally very similar to installation over new construction with the added steps of attaching the wood framework and placing risers on the roof surface before placing the support elements on the risers and subsequently placing steel roofing panels on the support elements. The steel panels are then preferably secured using nails or other method know to those skilled in the art. Those skilled in the art will recognize that risers, support elements and steel panels may also be installed over asphalt, ceramic, or any other roofing surface over which steel roofs may be installed.

Figure 4:
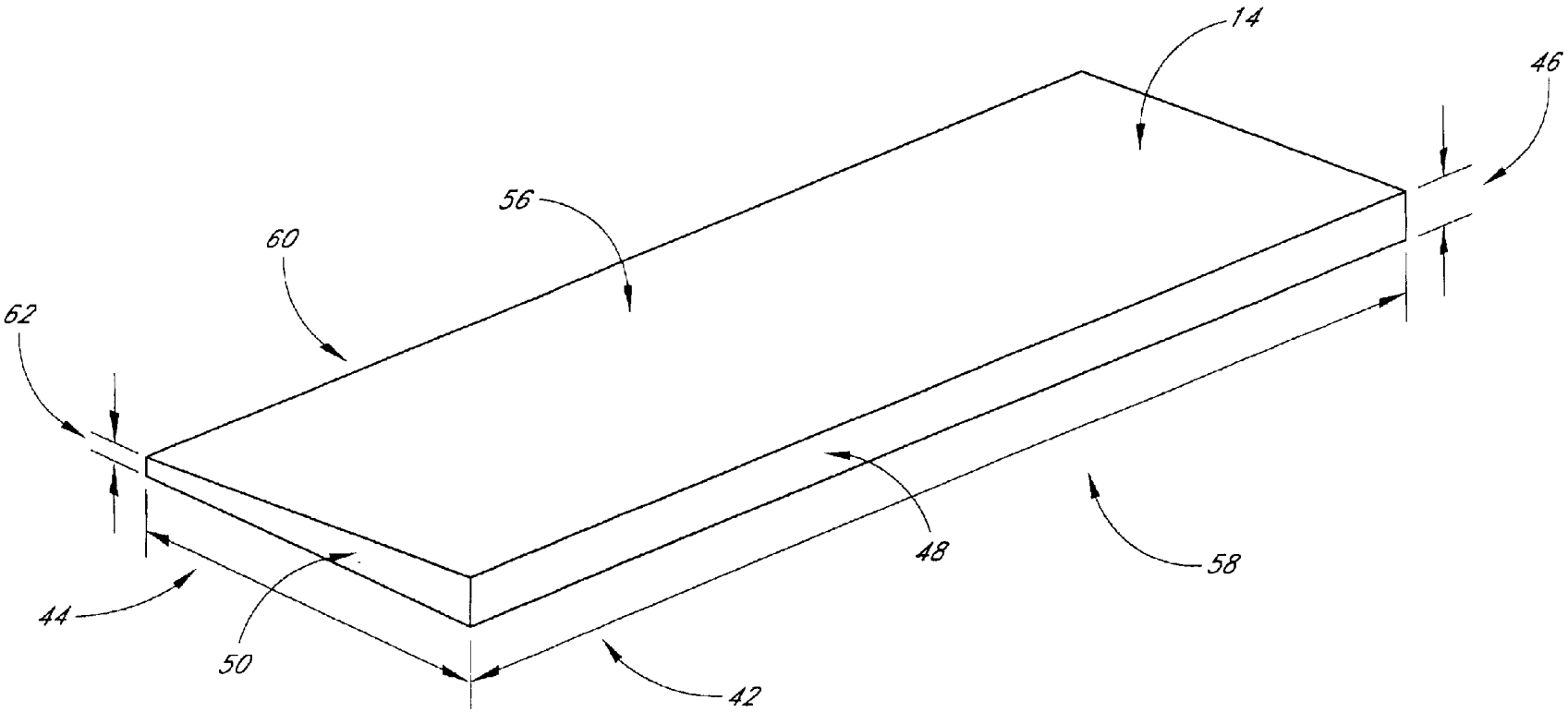
FIG. 4 is a perspective view of one embodiment of a support element.
Figure 5:
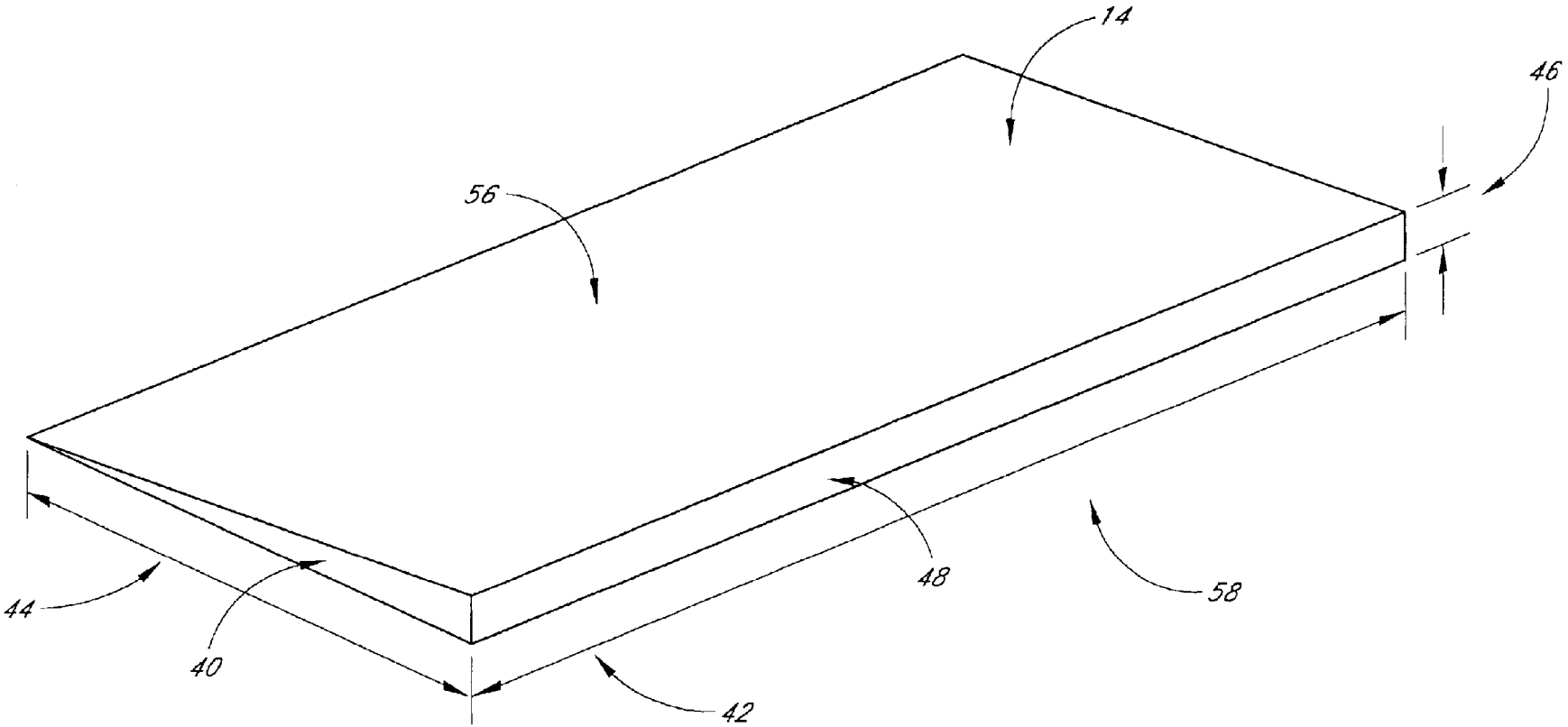
FIG. 5 is a perspective view of an alternative embodiment of a support element.

FIGS. 4 and 5 show steel roof panel support elements 14 having desired features and advantages. Support elements 14 are preferably independent of steel roof panels 16. Individual support elements 14 can be mass-produced for use with different, but similar, kinds of steel roof panels. Commercially available steel panels are available in a variety of shapes. For example, some steel panels have a scalloped cross-section, some are corrugated, and some have irregularly shaped cross-sections. Suitable steel roofing panels are manufactured by such companies as Gerard Roofing Technologies, MCA Roofing, and Tasman Roofing.

A support element having features and advantages of the present roof panel support is preferably substantially "wedge-shaped" as shown in FIG. 4. This wedge-shape has been shown to sufficiently support a variety of shapes of steel roof panels 16, regardless of the shape of the roof panel 16. The support element 14 shown in FIG. 4 has a quadrilateral cross-section 50. Alternatively, a support element may have a substantially triangular cross-section 40 as shown in FIG. 5.

The wedge-shaped supports with flat upper surfaces have been shown to adequately support steel roof panels despite contacting only the lowest-extending points of the panels. Field tests were performed in which steel roofing panels 16 manufactured by Tasman Roofing supported by a support element 14 were walked on. These tests indicate that with support elements 14 under the roof panels 16, roof panels 16 may deflect substantially but will not yield (i.e., will not permanently deflect). Thus, when a person walks along a steel roof, the steel panels 16 supported by support elements 14 may deflect initially, but will return to their original shape without damage or permanent denting.

The support element 14 is preferably made of expanded polystyrene foam. The support elements 14 are preferably cut from a large block of expanded polystyrene with a hot wire. Suitable foam, for example, is 1 lb. density foam manufactured by Insulfoam, Inc. Support elements manufactured in this way, are very inexpensive. The thickness and properties of the polystyrene are preferably such that support elements 14 do not have a negative effect on a roof's fire rating, and provide a thermal resistance rating (R-value) of about 4 to about 6.

The width 44 and the height 46 of the support element 14 will vary depending on the specific installation requirements. The height 46 at the front end 48 of the support element 14 is preferably the same height or slightly smaller (about $1/16^{th}$ inch smaller) than the height of the battens 20. Alternatively, the support element 14 may be taller than the height of the batten 20. The width 44 of the support element 14 is preferably such that that its bottom surface 58 covers a majority of the roofing surface 12 directly below the corresponding steel roof panels 16. The width 44 of the support element 14 is also preferably such that its top surface 56 contacts a majority of the surface of the downward-protruding portions 70 (FIG. 2*a*) under the corresponding steel roof panels.

A steel roof panel support element 14, with a rectangular or triangular cross section 40 may be designed to be compatible with steel roof panels such as those manufactured by Tasman, Inc., which are approximately 52.5" long, 14.5" wide, and made of about 26 gauge steel. The front end portion of the steel roof panel 16 may be formed such that it may overlap a lower course of steel panels 16, as shown in FIGS. 1–3. Of course, those skilled in the art will recognize that a variety of steel roof panels may also be used with supports as described herein.

A steel roof panel support element 14 designed to be compatible with such a steel panel could be 48" long 42, 12" wide 44, and preferably tapers from 1.5625" at the tall side 46 to about 0.5625" at its short side 62. Those skilled in the art will recognize that other sizes may be used depending on the needs of the specific installation and the size of the steel roofing panels 16 to be used. In such an arrangement, a steel panel 16 could be placed over the support element 14 such that the bottom surface 58 of the support element 14 would be covering a majority of the roofing surface 12 directly below the steel roof panel 16. As best seen in FIG. 2*a*, for a steel roof panel with a non-flat cross section, the downward-protruding portions 70 of the lower surface of the steel roof panel would be in contact with the top surface 56 of the support element 14. A majority of the surface area of the downward-protruding portions 70 of the steel roof panel 16, that is not contacting the battens 20 or in contact with the roofing surface 12, would be supported by the support element 14.

Figure 6:
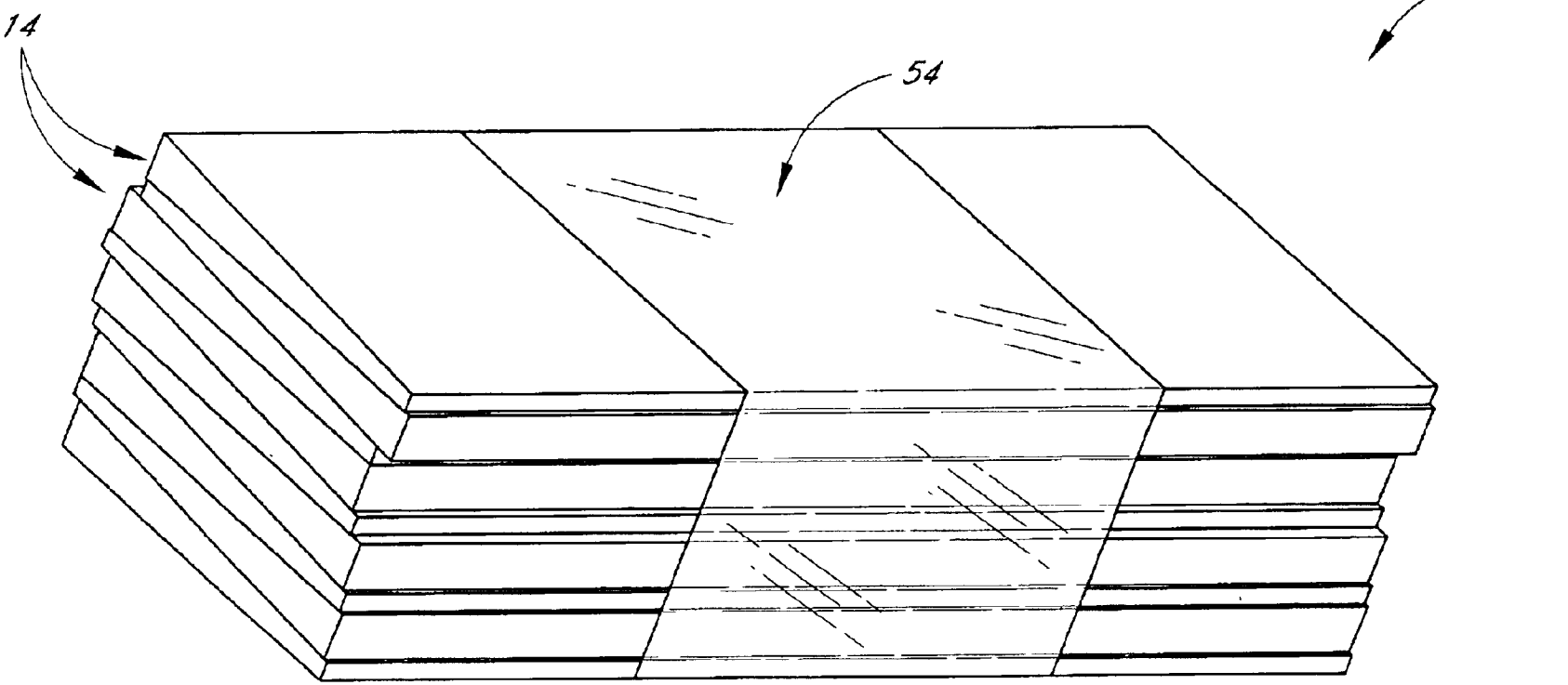
FIG. 6 is perspective view illustrating a method of packing support elements.

FIG. 6 illustrates a preferred packaging assembly 52 of steel roof panel support elements 14. A number of support elements 14 are shown arranged into a bundle 52. The support elements 14 are preferably stacked in an alternating fashion such that each overlaying support element 14 is turned 180° relative to the adjacent elements 14 stacked thereby. The support elements 14 are preferably bound with a plastic wrap 54 or some other method of binding. In another preferred embodiment, the support elements 14 are packaged in bags. Support elements 14 that are independent of steel roof panels are more cost effective in terms of packaging and delivery than combined structures.

Although certain preferred embodiments and examples have been described herein, it will be understood by those skilled in the art that the present inventive subject matter extends beyond the specifically disclosed embodiments to other alternative embodiments and/or uses of the invention and obvious modifications and equivalents thereof. Thus, it is intended that the scope of the present inventive subject matter herein disclosed should not be limited by the particular disclosed embodiments described above, but should be determined only by a fair reading of the claims that follow.

What is claimed is:

1. A roofing system comprising:

a steel roof panel having a non-planar shape;

a roof surface;

a wedge-shaped support element having a substantially planar upper surface, and disposed between said roof panel and said roof surface, wherein the shape of the support element is substantially independent of the shape of the roof panel; and wherein the support element is configured to allow the position of the roof panel to be adjusted laterally, forwards, or rearwards on the support element.

2. The roofing system of claim 1, wherein the support element is made of expanded polystyrene.

3. The roofing system of claim 2, wherein the support element is cut from a block of polystyrene.

4. A roofing system comprising:

a steel roof panel having a non-planar shape;

a roof surface;

a wedge-shaped support element having a substantially planar upper surface, and disposed between said roof panel and said roof surface, wherein the shape of the support element is substantially independent of the shape of the roof panel; and wherein the roof surface comprises previous roofing tiles.

5. The roofing system of claim 4, further comprising:

a plurality of strips disposed vertically on the tiles;

horizontal battens secure to the top of the strips;

a riser disposed between the strips, and underlying the horizontal battens.

6. A roofing system comprising:

a steel roof panel comprising a longitudinal cross-section with a repeating pattern including a plurality of high points and a plurality of low points;

a roof surface;

means for supporting a central portion of said panel on said roof surface, wherein the means for supporting contacts only the low points of the roof panel existing roof tiles;

a plurality strips disposed vertically on the tiles;

horizontal battens secure to the top of the strips; and a riser disposed between adjacent strips, and underlying the horizontal battens.

7. The roofing system of claim 6, wherein the means for supporting comprises a wedge of expanded polystyrene.

8. The roofing system of claim 6, wherein the roof panel comprises a corrugated shape.

9. A method of assembling a roof covering, comprising:

providing a first steel roof panel and a second steel roof panel;

providing a wedge-shaped support element;

placing said support element on a roof surface;

placing said first panel on said support element such that a portion of support element remains exposed;

placing said second panel on said support element such that the exposed portion is covered by the second panel; and securing said first and second panels and said support element to the roof surface;

wherein the roof panels have a non-planar shape as viewed in a cross-section parallel to a longitudinal axis of the panels.

10. The method of claim 9, wherein the support element is cut from a block of expanded polystyrene.

11. The method of claim 9, wherein the support element provides a thermal resistance rating of at least 4 $ft^2$°Fh/BTU.

12. The method of claim 9, further comprising, after placing the first panel, adjusting a position of the first roof panel on the support element by moving it laterally, forwards or rearwards.

13. A method of assembling a roof covering, comprising:

providing a first steel roof panel and a second steel roof panel;

providing a wedge-shaped support element;

placing said support element on a roof surface;

placing said first panel on said support element such that a portion of support element remains exposed;

placing said second panel on said support element such that the exposed portion is covered by the second panel; and securing said panel and said support element to the roof surface;

wherein the roof surface comprises a plurality of existing roof tiles, the method further comprising the steps of;

placing a plurality of strips vertically over a plurality of roof tiles;

placing a riser between adjacent strips;

placing horizontal battens over said strips and said riser.

14. A roofing system comprising:

a steel roof panel;

a roof surface comprising previous roofing tiles;

a wedge-shaped support element having a flat upper surface, and disposed between said roof panel, and said roof surface.

15. The roofing system of claim 14, further comprising:

a plurality of strips disposed vertically on the tiles;

horizontal battens secure to the top of the strips;

a riser disposed between the strips, and underlying the horizontal battens.

16. A roofing system comprising:

a steel roof panel;

a roof surface;

means for supporting a central portion of said panel on said roof surface;

existing roof tiles;

a plurality strips disposed vertically on the tiles;

horizontal battens secure to the top of the strips; and a riser disposed between adjacent strips, and underlying the horizontal battens.

17. The roofing system of claim 16, wherein the means for supporting comprises a wedge of expanded polystyrene.

18. A roofing system comprising:

a steel roof panel;

a roof surface; and means for supporting a central portion of said panel on said roof surface;

wherein the roof panel comprises a corrugated shape wherein the means for supporting comprises a wedge of expanded polystyrene.

19. The roofing system of claim 18, wherein the means for supporting a roof panel underlies a plurality of roof panels.

* * * * *